US007404229B2

(12) United States Patent
Monahan et al.

(10) Patent No.: US 7,404,229 B2
(45) Date of Patent: Jul. 29, 2008

(54) WET SPILL-DUST PAN

(75) Inventors: Patrick H. Monahan, Arcola, IL (US); Paul Temme, Wildwood, MO (US)

(73) Assignee: The Thomas Monahan Co., Arcola, IL (US)

( * ) Notice: Subject to any disclaimer, the term of this patent is extended or adjusted under 35 U.S.C. 154(b) by 27 days.

(21) Appl. No.: 11/306,518

(22) Filed: Dec. 30, 2005

(65) Prior Publication Data

US 2007/0151065 A1 Jul. 5, 2007

(51) Int. Cl.
*A47L 13/52* (2006.01)

(52) U.S. Cl. ..... 15/257.4; 15/257.1; 15/257.7; 15/257.9

(58) Field of Classification Search ..... 15/257.1–257.9; D32/74

See application file for complete search history.

(56) References Cited

U.S. PATENT DOCUMENTS

| | | | | | |
|---|---|---|---|---|---|
| 677,950 | A * | 7/1901 | Cutter | ..... | 15/257.4 |
| 820,627 | A * | 5/1906 | Curtis | ..... | 15/257.8 |
| 4,686,734 | A | 8/1987 | Alexander | | |
| 5,343,589 | A * | 9/1994 | Davenport | ..... | 15/257.4 |
| 5,412,835 | A | 5/1995 | Vosbikian et al. | | |
| 5,457,844 | A * | 10/1995 | Hanna et al. | ..... | 15/257.3 |
| 6,052,860 | A | 4/2000 | Coxsey | | |
| 6,233,780 | B1 | 5/2001 | Mead | | |
| 6,249,930 | B1 | 6/2001 | Noggle | | |
| 6,282,745 | B1 * | 9/2001 | Alt | ..... | 15/257.4 |
| 6,643,891 | B1 * | 11/2003 | Jerstroem et al. | ..... | 15/257.2 |
| 2005/0071943 | A1 * | 4/2005 | Liu | ..... | 15/257.2 |

FOREIGN PATENT DOCUMENTS

| | | | |
|---|---|---|---|
| JP | 10-165348 | * | 6/1998 |
| JP | 11-267081 | * | 10/1999 |
| JP | 11-309104 | * | 11/1999 |
| JP | 2002-238824 | * | 8/2002 |

* cited by examiner

*Primary Examiner*—Mark Spisich
(74) *Attorney, Agent, or Firm*—R. William Graham

(57) ABSTRACT

A wet spill-dust pan, which includes an arched-shaped base panel, a back wall extending upward from a back edge of said base panel, a pair of side walls connected to arched sides of said base panel and extend the length thereof in an upward manner and are interconnected to said back wall, a top panel interconnecting said back wall and part of said side walls, said base panel having an open front with a leading rubber blade portion over which debris and wet spilled material can be squeegee swept, a generally U-shaped handle having a transverse portion and a pair of laterally extending arms, wherein each said arm is pivotally connected to an outside of one of said side walls such that said transverse portion is laterally spaced from said top panel and extends thereacross.

6 Claims, 1 Drawing Sheet

WET SPILL-DUST PAN

FIELD OF THE INVENTION

The invention relates to cleaning implements for manual collection of debris and spills having a handle attached to a scoop into which the debris or spill can be squeegee swept for disposal. More particularly, the invention is directed to a spill-dust pan having a unique handle and scoop for better enabling pick up and removal of wet debris and liquid spills.

PRIOR ART

There exist a number of prior types of dust pans which are useful for cleaning in and about the home and commercial buildings. Dust pans commonly include a shallow container or scoop attached to a handle, the scoop or container having a substantially flat bottom and open on one edge. The scoop is rested on the ground and a broom or other implement is used to push dust or other debris over the edge and into the scoop. The handle is used to lift the scoop and dump the debris into a trash receptacle.

Typically, the handle extends from an end of the dust pan and forms part of a back of the scoop rigidly mounted thereto and lies generally in the same plane as the scoop. However, others provide for the handle to connect to a top part of the container with the handle running lengthwise and generally perpendicular to the open edge. The user must bend over to grasp the handle and/or must incline the dust pan at an angle to the floor, in order to place the edge of the scoop on the floor to gather dust.

Still, other pans have an elongated handle that protrudes upwardly from a back end of the container when the edge of the scoop is placed on the floor so that the user does not have to bend over, thus permitting the user to scoop with one hand and use a broom with the other hand. Such configured handles are found to be either rigidly or hingedly mounted to the container. It is also possible for the scoop to define a container having an open front at the edge of the scoop and a rear portion that is closed over the top of the scoop. The closed-rear form of scoop may swing freely on the elongated handle on a pivot axis near the front of the scoop such that the rear of the container drops downwardly when the scoop is lifted, capturing the debris. Whether or not the scoop is attached rigidly, the user of a dust pan with a handle perpendicular to the plane of the scoop does not have to bend over the dust pan to gather debris, and can proceed quickly from place to place to sweep up. While this facilitates one type of clean up, there are shortcomings with such dust pans having elongated upwardly extending handles for handling smaller clean up jobs.

For example, the long handles make it difficult and awkward for a user to dump the debris into a receptacle as the handle gets in the way. Another problem is that the elongated handle type requires more space in displays and in storage closets. Thus, employing this type for small jobs can be a nuisance. Some scoops have the pivot point connected inside the scoop which obstructs the sweeping or squeegee path.

It is desirable to provide a wet spill dust pan wherein the handle pivots on the dust pan container/scoop to provide for easy scooping of debris and spills and containment when carrying and dumping of the same. For example, the handle can be perpendicular or angles to the container of the spill dust pan for sweeping up debris or wet spills or generally parallel to the container for carrying or dumping. Also, there is a need for a wet spill-dust pan which provides a multifunctional handle attachment. There remains a need to improve upon the art and the present invention provides such improvement.

SUMMARY OF THE INVENTION

It is an object of the invention to improve dust pans.

It is another object to provide a wet spill-dust pan.

It is another object to provide an easy to use wet spill-dust pan.

It is another object to provide an easy to carry wet spill-dust pan.

It is another object to provide an easy to dump wet spill-dust pan.

It is another object of the invention to provide a durable wet spill-dust pan.

It is another object to provide an easy to merchandise wet spill-dust pan.

It is another object to provide an easy to display wet spill-dust pan.

It is another object to provide an easy to store wet spill-dust pan.

It is another object to provide a wet spill-dust pan having a multi-functional handle attachment.

Accordingly, the present invention is directed to a wet spill-dust pan. The wet spill-dust pan has a container which includes an arched-shaped base panel having a back wall extending upward from a back of the base panel, a pair of side walls connected to arched sides of the base panel and extend the length thereof in an upward manner and are interconnected to the back wall, a top panel interconnecting the back wall and part of the side walls. The top panel can be partially extending over the base panel and terminating short of the length of the side walls. The side walls have an edge, which can be preferably slanted, interconnecting an open front of the top panel and an open front of the base panel. The base open front has a leading rubber blade portion over which debris and wet spilled material is squeegee swept. The leading rubber blade portion is flexible to allow a sealing contact to be made between the leading contact edge of the wet spill-dust pan and the surface to be cleaned to permit collection of spills and debris.

The wet spill-dust pan further includes a handle pivotally connected to the side walls proximate the slanted edge and the top panel. Each side wall includes a retention bearing surface to pivotally receive a pivotal retainable end of a generally U-shaped handle having a transverse portion laterally spaced from the top panel and extending thereacross. The retention bearing surfaces for the handle can be integrally formed in or attached to the side wall and form a pivot joint. There is also provided a recessed surface in each side wall to retain an arm of the handle and limit handle movement between a generally parallel position to the container in a carrying mode or storage mode and an angled position with respect to the container for use in scooping spills and debris.

There has thus been outlined various features of the invention in order that the detailed description thereof that follows may be better understood and in order that the present contribution to the art may be better appreciated. Other features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 2:
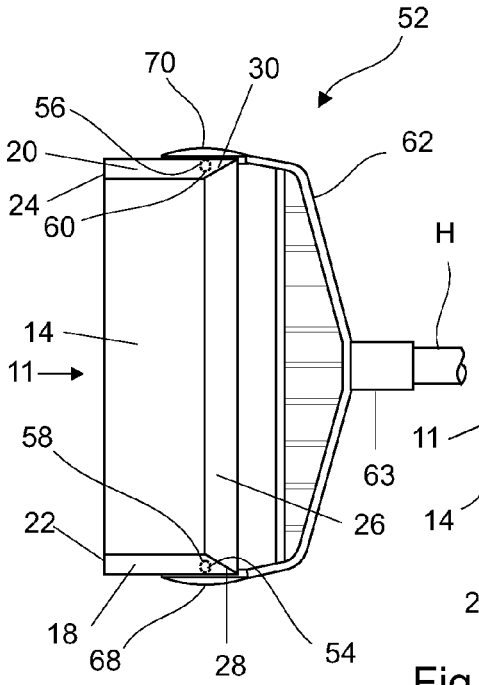
FIG. 2 is a rear view of the instant invention.
Figure 1:
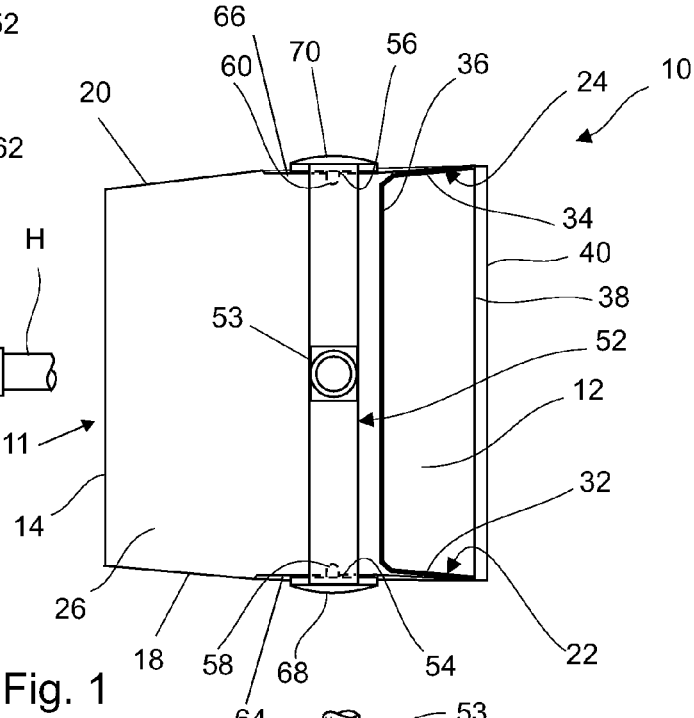
FIG. 1 is a top view of a spill-dust pan in accordance with the invention.

Referring now to the drawings, an embodiment of wet spill-dust pan of the present invention is generally designated by the numeral 10. One preferred embodiment depicted in the drawings includes a wet spill-dust pan 10 for collecting spills and debris having a container 11 which includes an arched-shaped base panel 12 having a back wall 14 extending upward from a back edge 16 of the base panel 12. A pair of side walls 18 and 20 connect to arched side edges 22 and 24, respectively, of the base panel 12 and extend the length thereof in an upward manner and are interconnected to the back wall 14.

A top panel 26 interconnects the back wall 14 an upper edge portion 28 and 30 of the side walls 18 and 20. The top panel 26 can be partially extending over the base panel 12 and terminating short of the length of the side walls 18 and 20. The side walls 18 and 20 have an edge 32 and 34, respectively, which can be preferably slanted, interconnecting a front edge 36 the top panel 26 and a front edge 38 of the base panel 12.

Figure 4:
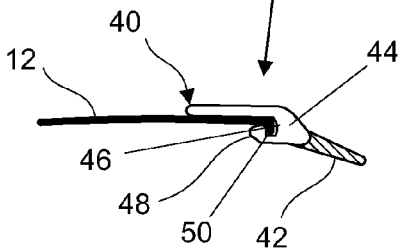
FIG. 4 is a sectional view of a part of the invention.

The front edge 38 of base panel 12 preferably has a leading rubber blade portion 40 snap fit thereto. To this end, the rubber blade portion 40 is seen in FIG. 4 as having a relatively flexible and thin leading contact edge 42 connected to a relatively thicker rigid portion 44 having a grooved surface 46 and retention lip 48. The grooved surface receives the front edge 38 of the base panel 12 wherein the base panel 12 includes a flanged surface 50 to receive the retention lip 48 thereabout and together retain the rubber blade portion 40 on the base panel 12 in a manner over which debris and spilled material is scooped or swept. The leading rubber contact edge 42 is flexible to allow a sealing contact to be made between the leading contact edge 42 of the spill-dust pan 10 and the surface to be cleaned to permit collection of spills and debris.

Figure 3:
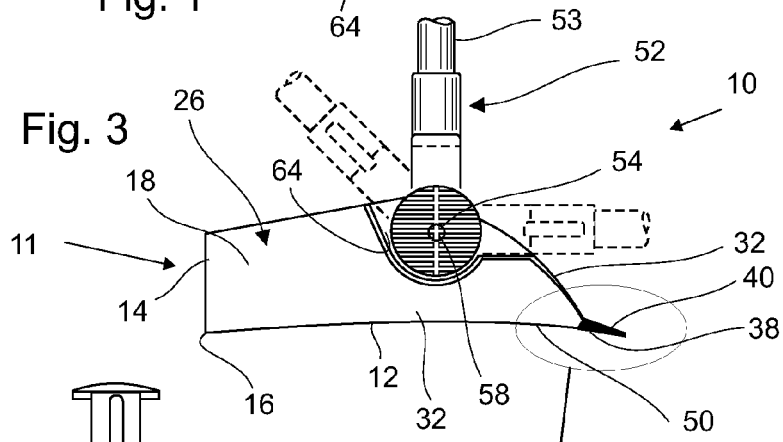
FIG. 3 is a side view of the invention.
Figure 5:
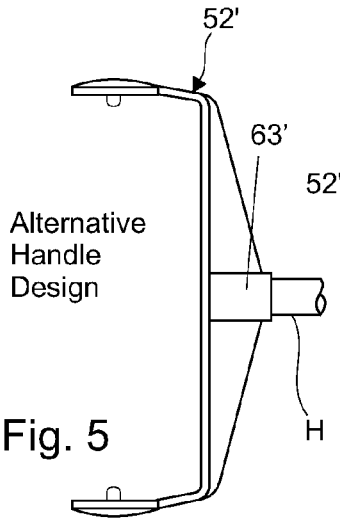
FIG. 5 is side view of another part of the invention.
Figure 6:
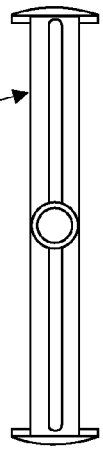
FIG. 6 is a top view of the part in FIG. 5

Connected to the side walls 18 and 20 proximate the slanted edges 32 and 34 and the top panel 26 is a pivotally attached handle 52, wherein each side wall 18 and 20 includes a retention bearing surface 54 and 56, respectively, to pivotally receive from outside the walls 18 and 20 a pivotal retainable end portion 58 and 60, respectively, of the generally U-shaped handle 52. The bearing surfaces 54 and 56 limit range movement of arms of the U-shaped handle 52 to less than about 180°. The handle 52 has a transverse portion 62 which when the handle 52 is connected to the side walls 18 and 20 is laterally spaced from the top panel 26 and extends thereacross. A threaded neck 63 extends from the transverse portion to receive an elongated handle H in the event one is desired by the user. An alternative handle 52" design is shown in FIG. 6. There are further provided recessed surfaces 64 and 66 adjacent the retention bearing surfaces 54 and 56 which can be integrally formed in or attached to the side walls 18 and 20, respectively, and form a pivot joint to receive and limit movement of arms 68 and 70 for the handle 52 between a generally parallel position to the container 11 in a carrying mode or storage mode and an angled position with respect to the container 11 for use in scooping spills and debris as can be understood in viewing FIG. 3. The increased swiveling radius of the handle 52 on the wet spill-dust pan 10 allows for easier function of the wet spill-dust pan 10 as well as accommodating users of different heights.

It can now be appreciated that the invention in the cleaning mode quickly enables the pick up wet spills and such as those which might occur in a grocery store in the case of a broken bottle and spilled liquid which require a quick and easy spill-dust pan for clean up so the stores customers can have full access to the entire store. Existing commercial use dust pans are either too big for such types of job clean-ups or lack a suitable means to avoid the liquid slipping under the leading edge of the dust pan, such as the rubber blade and arched base of the present invention which enables such clean-up. The present invention also provides the ability for the transverse handle portion to swing back or forward to enable use ergonomically such as when trying to use a squeegee to pull the spilled liquid into the pan, the handle needs to be lower to assist this effort. Additionally, the present invention allows for the attachment of an elongated handle should the need be required.

The spill-dust pan of the instant invention can provide a useful yet shorter, narrower, and lower configuration. For example, the width of the spill-dust pan can be slightly larger than a standard squeegee, used for liquid control, such as about 6 inches. This keeps the liquids from going around the spill-dust pan. This, along with the ability of the handle to swivel back toward the user, facilitates pulling a full stroke of liquid into the pan. The present configuration permits a compact height/width so that it also fits closer to the wall when stored by hanging, leaving a minimum protrusion in the storage area. The reduction in all these dimensions means it is easier for the user to control the "sloshing" of the liquids in the pan. The pan can preferably be downsized to allow various people to handle the weight of liquid filled pan. The rubber leading edge "seals" the pan to the floor so liquids don't slide under the pan.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

While this invention has been described in connection with the best mode presently contemplated by the inventor for carrying out his invention, the preferred embodiments described and shown are for purposes of illustration only and are not to be construed as constituting any limitations of the invention. Modifications will be obvious to those skilled in the art and all modifications that do not depart from the spirit of the invention are intended to be included within the scope of the appended claims. The invention resides not in any one of these features per se, but rather in the particular combination of all of them herein disclosed and claimed and it is distinguished from the prior art in this particular combination of all of its structures for the function specified.

The invention having been disclosed, variations and additional embodiments in accordance with the invention will now be apparent to persons skilled in the art. Whereas the invention is not intended to be limited to the exemplary embodiments and will encompass a range of such variations, reference should be made to the appended claims rather than the foregoing specification to assess the scope of the invention in which exclusive rights are claimed.

What is claimed is:

1. A wet spill-dust pan, which includes:

a container which having a slightly arched-shaped base panel, a back wall extending upward from a back edge of said base panel, a pair of side walls connected to sides of said base panel and extend the length thereof in an upward manner and are interconnected to said back wall wherein each said side wall includes a recessed surface at a front end thereof and each said recessed surface includes a retention bearing surface, a top panel interconnecting said back wall and part of said side walls, said base panel having an open front having a front edge with a leading rubber blade portion over which debris and wet spilled material can be squeegee swept, and a generally U-shaped handle having a transverse portion and a pair of laterally extending arms, wherein each said recessed surface receive at least part of each said arm and defines a pair of end surfaces on opposite sides of said retention bearing surface adapted to abut said arms in a manner to limit movement of said arms to less than 180° between a generally parallel position to said base panel in a carrying mode and storage mode and an angled position with respect to said base panel for use in scooping spills and debris, wherein each said retention bearing surface pivotally receive a pivotal retainable end of each said arm such that each said arm is pivotally connected to one of said side walls such that said transverse portion is laterally spaced from said container.

2. The wet spill dust pan of claim 1, wherein said top panel partially extends over said base panel and terminates short of the length of said side walls, and said side walls each have a forward edge interconnecting said top panel and base panel.

3. The wet spill dust pan of claim 2, wherein said forward edges are slanted.

4. The wet spill dust pan of claim 1, wherein said leading rubber blade portion is flexible to allow a sealing contact to be made between the leading contact edge of the spill-dust pan and the surface to be cleaned to permit collection of spills and debris.

5. The wet spill dust pan of claim 1, which is further characterized as having a relatively flexible and thin leading contact edge connected to a relatively thicker rigid portion having a grooved surface and retention lip, wherein said grooved surface receives said front edge of said base panel wherein said base panel includes a flange surface to receive said retention lip thereabout and together retain said rubber blade portion on said base panel in a manner over which debris and spilled material is scooped or swept.

6. The wet spill dust pan of claim 1, which is further includes a threaded neck extending out from said transverse portion to receive a threaded elongated handle thereto.

* * * * *